US007246580B2

(12) United States Patent
Palesch et al.

(10) Patent No.: US 7,246,580 B2
(45) Date of Patent: Jul. 24, 2007

(54) CAMSHAFT ADJUSTER FOR VEHICLES, ESPECIALLY MOTOR VEHICLES

(75) Inventors: Edwin Palesch, Lenningen (DE); Axel-Willi Jochim, Nürtingen (DE); Andres Nicklass, Nürtingen (DE); Andreas Knecht, Kusterdingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 418 days.

(21) Appl. No.: 10/709,216

(22) Filed: Apr. 22, 2004

(65) Prior Publication Data

US 2004/0244745 A1 Dec. 9, 2004

(30) Foreign Application Priority Data

Apr. 22, 2003 (DE) ..... 103 20 639

(51) Int. Cl.
*F01L 1/34* (2006.01)

(52) U.S. Cl. ..... 123/90.17; 123/90.15; 484/160

(58) Field of Classification Search ..... 123/90.15, 123/90.16, 90.17, 90.18; 464/1, 2, 160
See application file for complete search history.

(56) References Cited

U.S. PATENT DOCUMENTS 5,138,985 A * 8/1992 Szodfridt et al. ..... 123/90.17
6,035,816 A * 3/2000 Ogawa et al. ..... 123/90.17
6,390,043 B1 5/2002 Niethammer et al.
2001/0027763 A1 10/2001 Simpson et al.
2003/0000490 A1 1/2003 Katayama et al.
2003/0037741 A1 2/2003 Kohrs

FOREIGN PATENT DOCUMENTS

DE 199 34 405 A1 2/2001
DE 100 29 261 A1 12/2001
DE 101 61 701 A1 6/2003
DE 102 21 734 A1 11/2003
JP 09 280020 A1 10/1997

* cited by examiner

*Primary Examiner*—Ching Chang
(74) *Attorney, Agent, or Firm*—Gudrun E. Huckett

(57) ABSTRACT

A camshaft adjuster for motor vehicles has an oscillating motor having a rotor that is fixedly connected to a camshaft and further having a stator surrounding the rotor. The rotor is rotatable relative to the stator. At least one connecting part acting by at least one of positive engagement and force transmission is provided on a camshaft having cams. The rotor has a base member that is fixedly mounted on the connecting part. The base member has a diameter that is different from a diameter of a circle circumscribing the cams of the camshaft.

28 Claims, 11 Drawing Sheets

CAMSHAFT ADJUSTER FOR VEHICLES, ESPECIALLY MOTOR VEHICLES

BACKGROUND OF INVENTION

1. Field of the Invention

The invention relates to a camshaft adjuster for vehicles, especially motor vehicles, comprising an oscillating motor having a rotor that is fixedly connected to the camshaft and rotatable relative to a stator surrounding the rotor.

2. Description of the Related Art

Camshaft adjusters are known that have an oscillating motor that is connected at the end of a camshaft by means of a central screw. By hydraulically loading the rotor of the oscillating motor, a rotatory movement relative to the stator results and, in this way, an adjustment of the camshaft relative to the crankshaft is achieved. The supply of hydraulic medium is realized either directly through the camshaft or by means of a rotary lead-through in the oscillating motor. It is also known to fasten the rotary lead-through behind the oscillating motor by means of the central screw on the camshaft. The camshaft adjuster has a complex configuration and requires a correspondingly complex assembly.

SUMMARY OF INVENTION

It is an object of the present invention to configure the camshaft adjuster of the aforementioned kind such that, while providing a simple configuration, an inexpensive assembly is ensured without this negatively affecting the proper function of the camshaft adjuster.

In accordance with the present invention, this is achieved in that the camshaft comprises at least one connecting part that acts by positive-engagement and/or force transmission and on which the base member of the rotor is fixedly mounted, wherein the base member has a diameter that is different than the diameter of the circle circumscribing the cams of the camshaft.

In the camshaft adjuster according to the invention, the rotor is fixedly connected by means of a positive-engagement and/or force transmission part to the camshaft. Because of the configuration according to the invention, the camshaft adjuster has only a minimal number of components, and this leads to a simple and inexpensive assembly.

Advantageously, the inner diameter of the base member of the rotor is greater than the diameter of the circle that circumscribes the cams of the camshaft. Accordingly, the oscillating motor can be pushed axially across the cams onto the positive-engagement and/or force transmission part. The camshaft requires therefore only two bearing locations.

DETAILED DESCRIPTION

Figure 2:
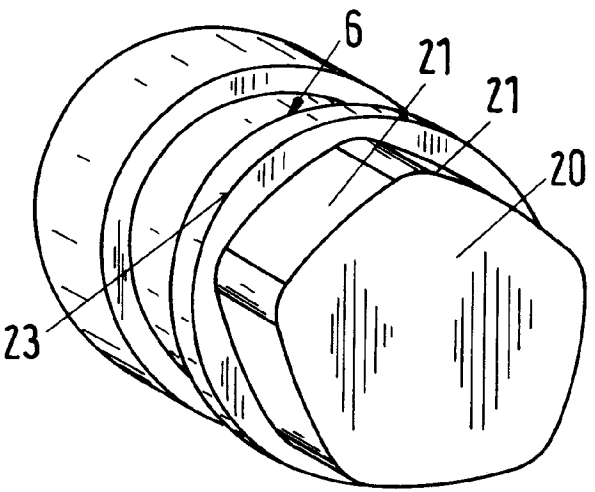
FIG. 2 is a perspective illustration of a camshaft of the camshaft adjuster according to FIG. 1 provided with a positive-engagement part for receiving a rotor of the camshaft adjuster.
Figure 1:
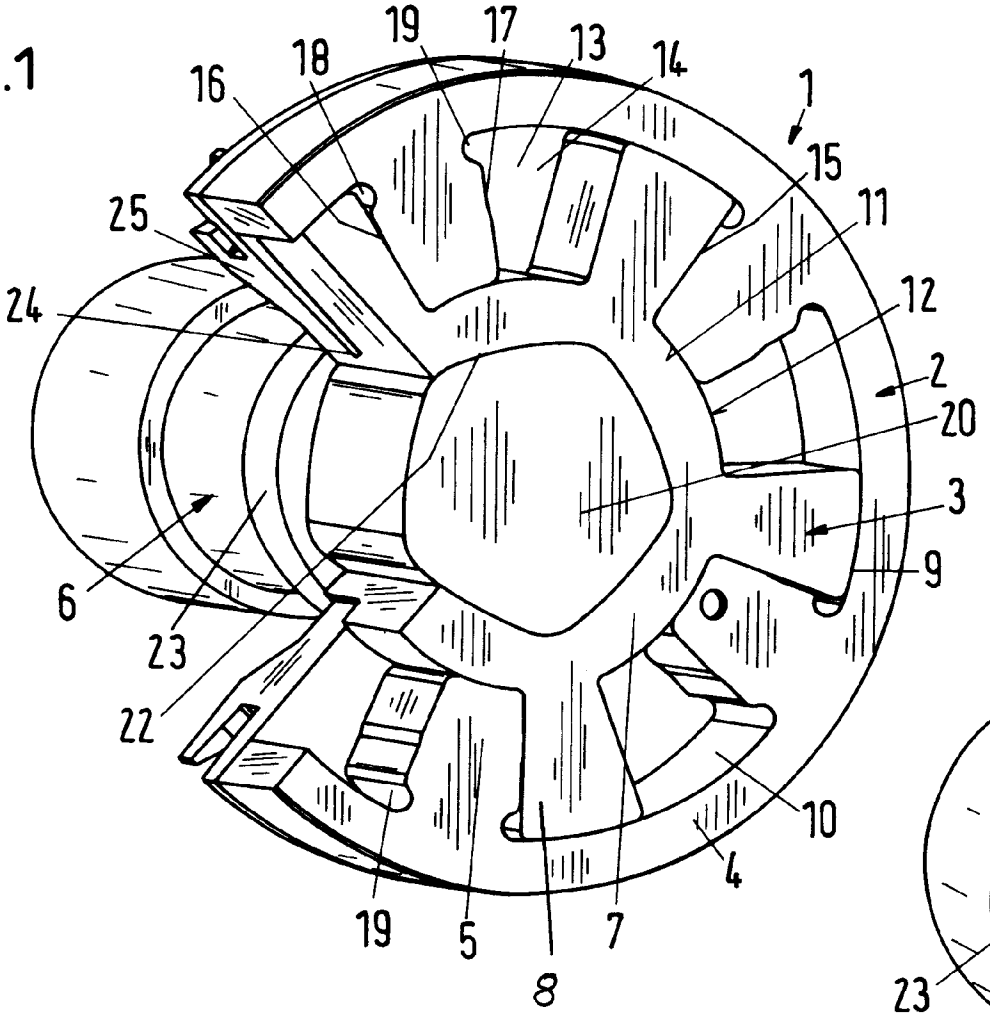
FIG. 1 is a perspective illustration, partially in section, of a camshaft adjuster according to the invention.

The camshaft adjuster according to FIGS. 1 and 2 has an oscillating motor 1 comprising a stator 2 and a rotor 3. The stator 2 has a cylindrical outer wall 4 and webs 5 projecting radially inwardly from the wall 4 at a uniform spacing to one another. The rotor 3 is mounted fixedly on the camshaft 6 and has an annular base member 7 that is fastened fixedly on the camshaft 6. Web-shaped vanes 8 project from the base member 7 radially outwardly and are spaced at a uniform spacing to one another. The end faces 9 of the vanes 8 rest areally on the inner side 10 of the outer wall 4 of the stator 2. The stator webs 5 rest with their end faces 11 areally on the cylindrical outer side 12 of the base member 7 of the rotor 3. The spacing of neighboring stator webs 5 from one another is greater than the width of the rotor vanes 8. The stator webs 5 delimit pressure chambers 13 that are divided by the rotor vanes 8 into two pressure chambers 14 and 15. A pressure medium can be introduced into the pressure chambers 14, 15 in a way known in the art so that the rotor vanes 8 can be pressure-loaded alternatingly on one or the other side. Accordingly, the rotor 3 is rotated relative to the stator 2. The maximum rotational travel of the rotor 3 relative to the stator 2 is achieved when the rotor vanes 8 rest against the stator webs 5.

On the radial outer ends of the sidewalls 16, 17 of each stator web 5, a recess in the form of a groove 18, 19 is provided that extends across the axial width of the stator webs 5. In the grooves 18, 19, dirt particles, for example, are collected that are contained within the pressure medium. Moreover, the pressure medium that is contained in the grooves 18, 19 provides a damping action when the rotor vanes 8 come to rest against the sidewalls 16, 17 of the stator webs 5. The stator webs 5 can have very different shapes. For example, the sidewalls 16, 17 of the stator webs 5 can be plane. The sidewalls 16, 17 can also have a different course. For example, the cross-sectional width of the stator webs 5 can taper irregularly radially inwardly. The stator 2 itself is provided, as is known in the art, with a chain wheel or pulley 25 across which a chain or belt is guided that is, in turn, guided across a chain wheel or pulley that is mounted on the crankshaft.

The camshaft 6 has a positive-engagement connecting part 20 that has a non-round cross-section. In the illustrated embodiment of FIGS. 1 and 2, the positive-engagement connecting part 20 has a pentagon-shaped cross-section wherein the circumferential surfaces 21 of the positive-engagement connecting part 20 have a rounded transition into one another. The base member 7 of the rotor has an inner wall 22 whose contour is matched to the contour of the positive-engagement connecting part 20. The rotor 3 is pushed onto the positive-engagement connecting part 20 wherein as a result of the non-round cross-section a proper fixed connection between the rotor 3 and the camshaft 6 is achieved so that the parts cannot rotate relative to one another.

The cams that are arranged on the camshaft 6 are positioned, as is known in the art, angularly displaced relative to one another. The circumcircle of the cam profiles is smaller than the smallest diameter of the positive-engagement connecting part 20. In this way, it is possible to push the rotor 3 across the cams of the camshaft 6 onto the positive-engagement connecting part 20. In this way, a central drive is enabled in a simple way. By means of the positive-engagement connecting part 20, the supply of the pressure medium that is to be introduced into the pressure chambers 14, 15 of the oscillating motor 1 can be realized. The corresponding bores in the positive-engagement connecting part 20 for supplying the pressure medium are not illustrated in FIGS. 1 and 2. In place of such bores, it is also possible to provide annular grooves on the positive-engagement connecting part 20.

The rotor 3 is fastened with its base member 7 in a suitable way on the positive-engagement connecting part 20, preferably by press-fit. A cylindrical collar 23 adjoins the positive-engagement connecting part 20. The collar 23 projects radially past the positive-engagement connecting part 20 and serves as an abutment or axial stop for the base member 7 of the rotor 3. By means of this collar 23, the rotor 3 can moved into its mounting position in a simple way during mounting.

As illustrated in FIG. 1, the base member 7 of the rotor has an axial annular projection 24 with which the base member 7 rest against the collar 23 of the camshaft 6. On this projection 24 a chain wheel 25 is supported that is fixedly connected to the stator 2. The chain wheel or pulley 25 can also be formed as a monolithic part of the stator 2. The chain wheel or pulley 25 closes off the pressure chambers 14, 15 in the axial direction. On the opposite side, a cover plate (not illustrated) is provided that is fastened on the stator 2 and closes off the pressure chambers axially on the other side.

Figure 3:
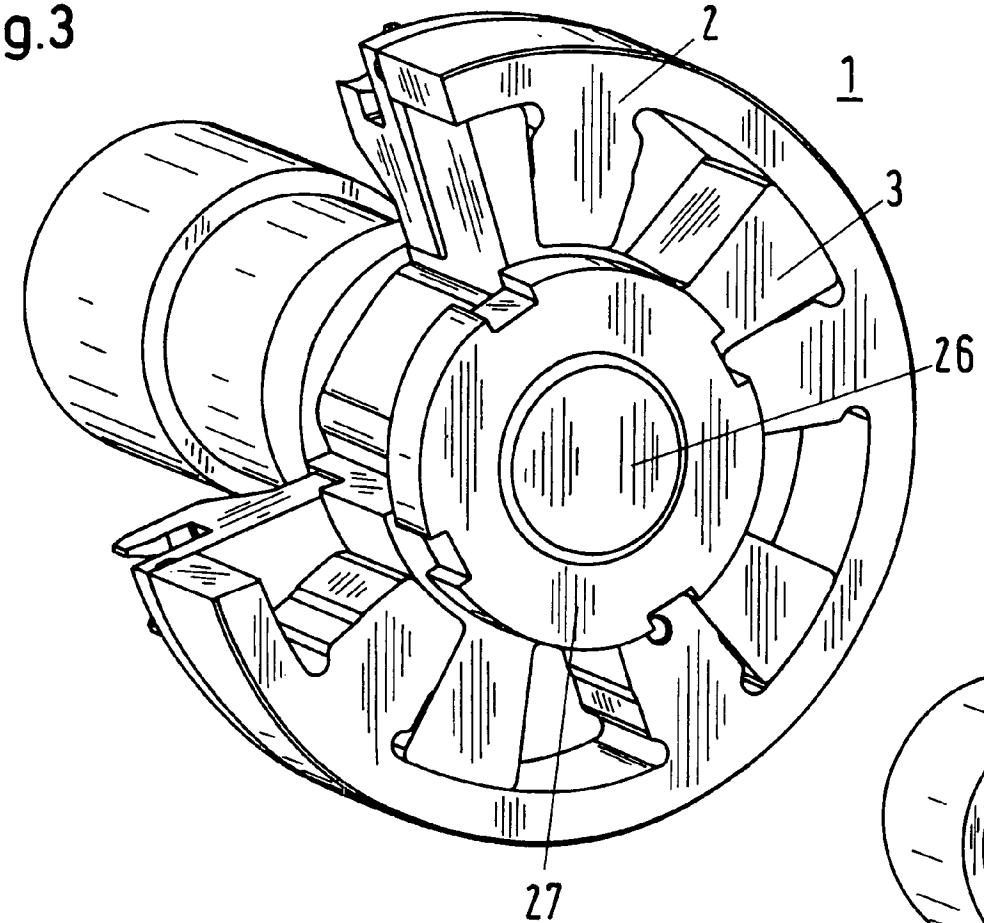
FIG. 3 is a second embodiment of a camshaft adjuster according to the invention in an illustration similar to FIG. 1.
Figure 4:
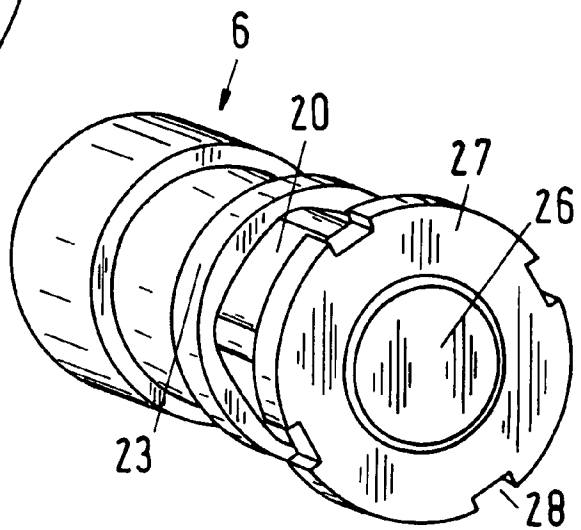
FIG. 4 shows the second embodiment of FIG. 3 in an illustration similar to FIG. 2.

In the embodiment according to FIGS. 3 and 4, the camshaft 6 is extended axially past the positive-engagement connecting part 20. On the projecting cylindrical part 26 of the camshaft 6, an axial securing element 27 is secured by press-fit whose outer diameter is greater than the greatest outer diameter of the positive-engagement part 20. The axial securing element 27 is formed as an annular disk and has on its circumference four grooves 24 that are spaced at an angular spacing of 90E relative to one another and serve as positive-engagement openings for a tool with which the axial securing element 27 can be placed onto the camshaft part 26. As described in the preceding embodiment, the rotor 3 is moved across the cams of the camshaft 6 onto the positive-engagement connecting part 20 and is secured thereon by press-fit. The part 26 projects past the rotor 3 in the axial direction. The axial securing element 27 is fastened on the part 26. For example, it can be pressed onto this projecting part 26. It is also possible to provide the projecting part 26 with a thread so that the axial securing element 27 is screwed onto the part 26. In the mounted position, the axial securing element rests against the cover plate (not illustrated) that is pushed by the axial securing element 27 against the stator 2.

The oscillating motor 1 is in other respects of the same configuration as in the preceding embodiment.

Figure 6:
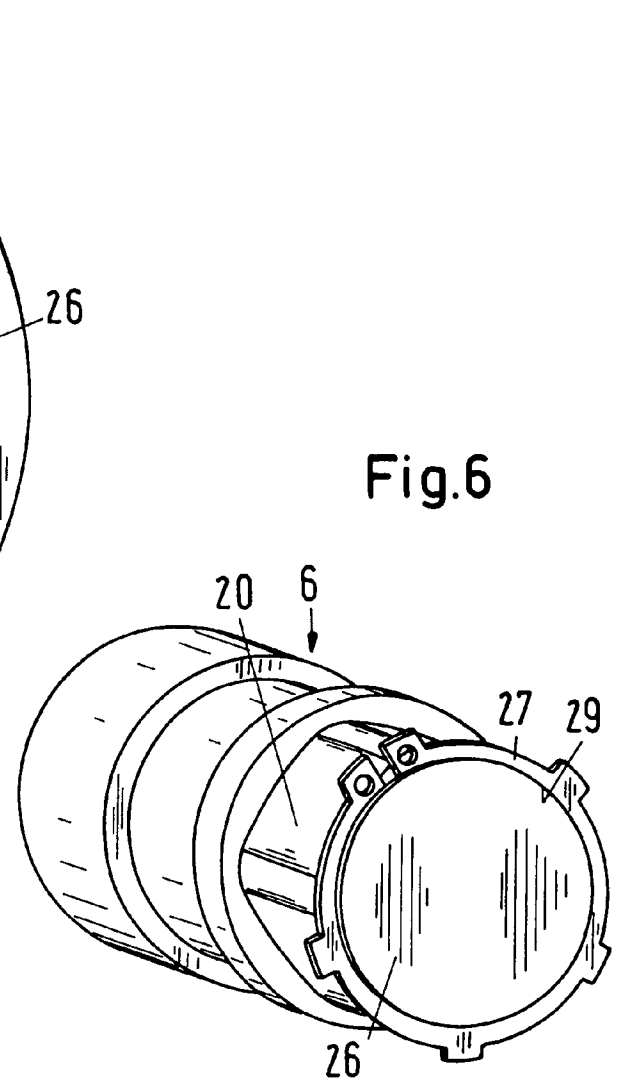
FIG. 6 shows the third embodiment of the camshaft adjuster in an illustration similar to FIG. 2.
Figure 5:
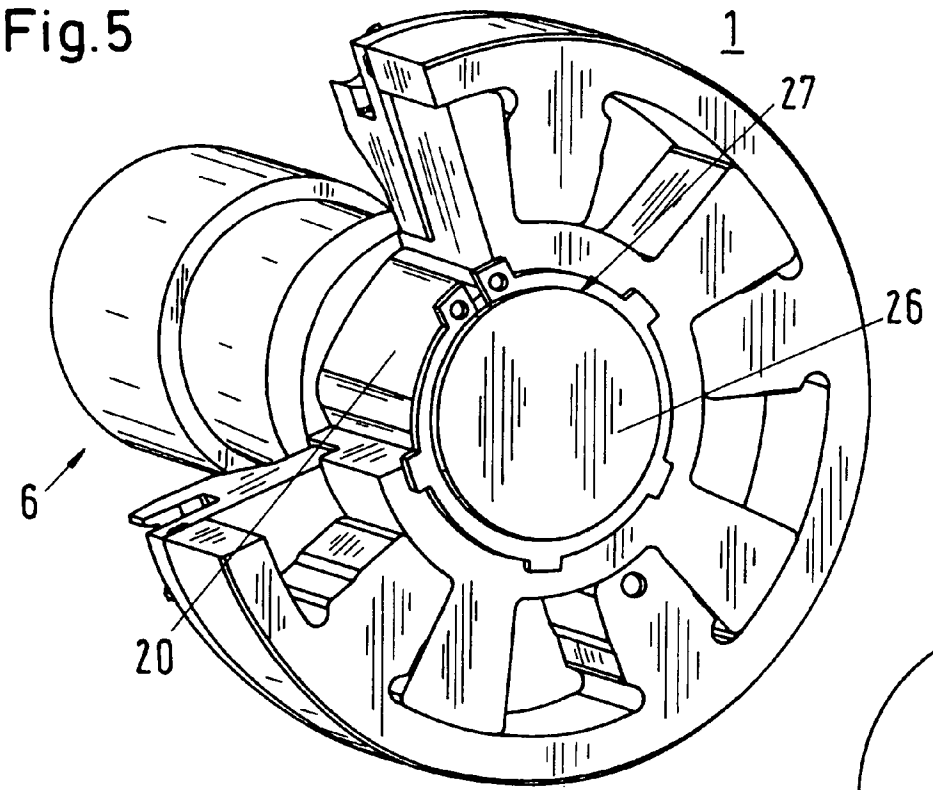
FIG. 5 shows a third embodiment of the camshaft adjuster according to the invention in an illustration similar to FIG. 1.

In the embodiment according to FIGS. 5 and 6, the axial securing element 27 is formed by a spring ring or securing ring that is inserted into an annular groove 29 near the free end of the projecting part 26 of the camshaft 6.

In the mounted position, the part 26 of the camshaft 6 projects past the cover plate (not illustrated) of the oscillating motor. Into the annular groove 29 a spring ring or securing ring 27 is inserted so that the oscillating motor 1 is properly axially secured on the positive-engagement connecting part 20 of the camshaft 6.

Figures 7, 8:
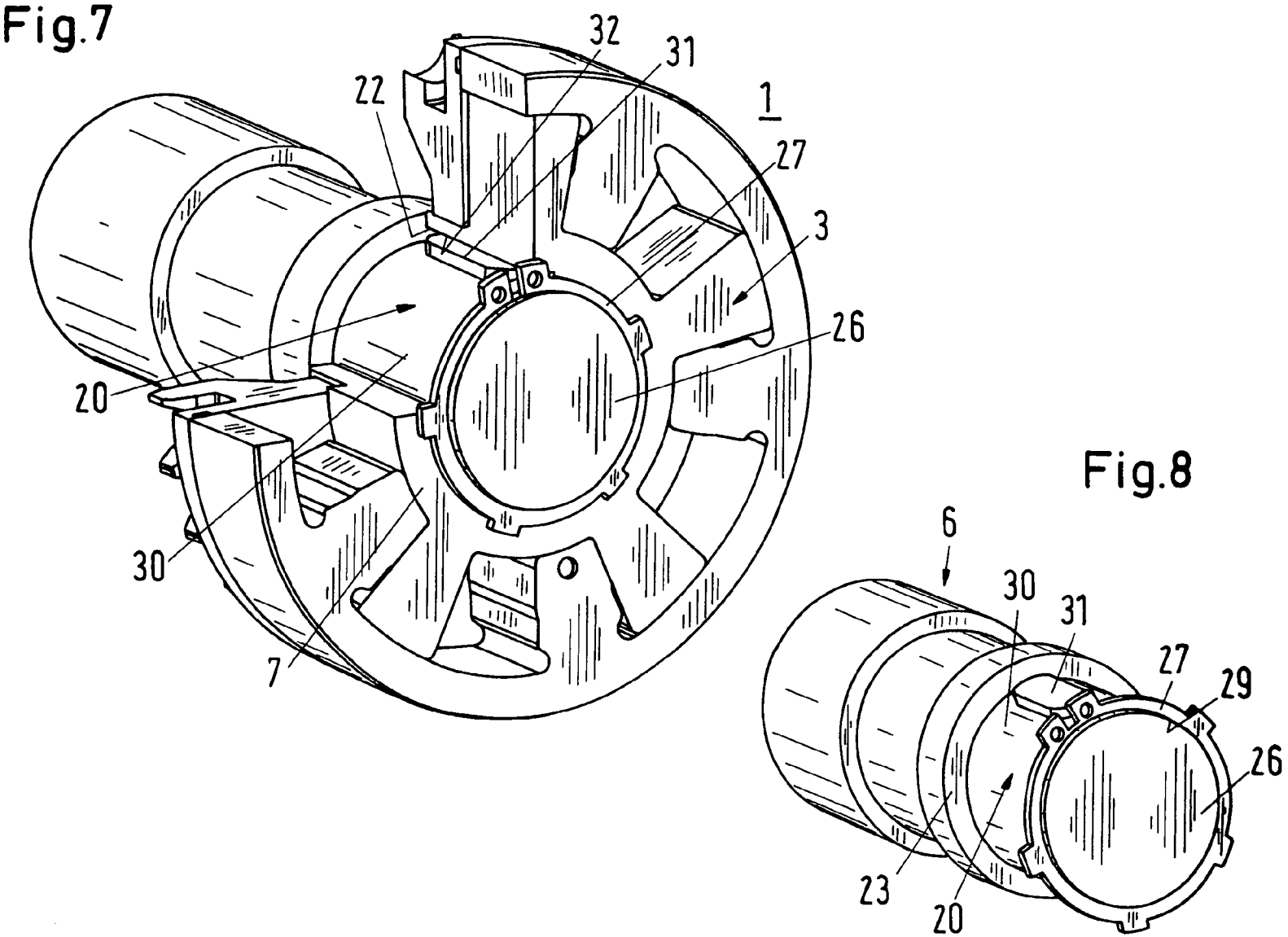
FIG. 7 shows a fourth embodiment of the camshaft adjuster according to the invention in an illustration similar to FIG. 1.
FIG. 8 shows the fourth embodiment of the camshaft adjuster in an illustration similar to FIG. 2.

In the oscillating motor according to FIGS. 7 and 8, a spring ring or securing ring is used as the axial securing element 27 that is provided in the annular groove 29 near the free end of the axially projecting end of the camshaft 6.

The positive-engagement connecting part 20, in contrast to the preceding embodiment, is substantially cylindrical. The positive-engagement connecting part 20 has on its outer wall 30 at least one positive-engagement element 31 that is formed as a projection on the outer wall 30. This positive-engagement element 31 has a substantially rectangular contour and extends from the collar 23 in the direction toward the annular groove 29. As illustrated in FIG. 8, the axially extending positive-engagement element 31 has a sufficient spacing from the annular groove 29 so that, when mounting the oscillating motor 1, the spring ring or securing ring 27 can be inserted simply into the annular groove 29.

The inner wall 22 of the base member 7 of the rotor 3 has for receiving the positive locking element 31 a matching groove-shaped depression 32 that is engaged positively by the positive-engagement element 31. By means of this positive-engagement connection 31, 32, the rotor 3 is connected fixedly to the camshaft 6. Since the rotor 3 is not secured by press-fit on the positive-engagement connecting part 20, a problem-free mounting of the rotor 3 is ensured. It can be easily pushed onto the positive-engagement connecting part 20. The axial securing action is realized by the spring ring or securing ring 27 that can be inserted without problems into the annular groove 29 of the camshaft part 26.

On the outer wall 30 of the positive-engagement connecting part 20 additional positive-engagement elements 31 can be provided should this be necessary.

Figure 9:
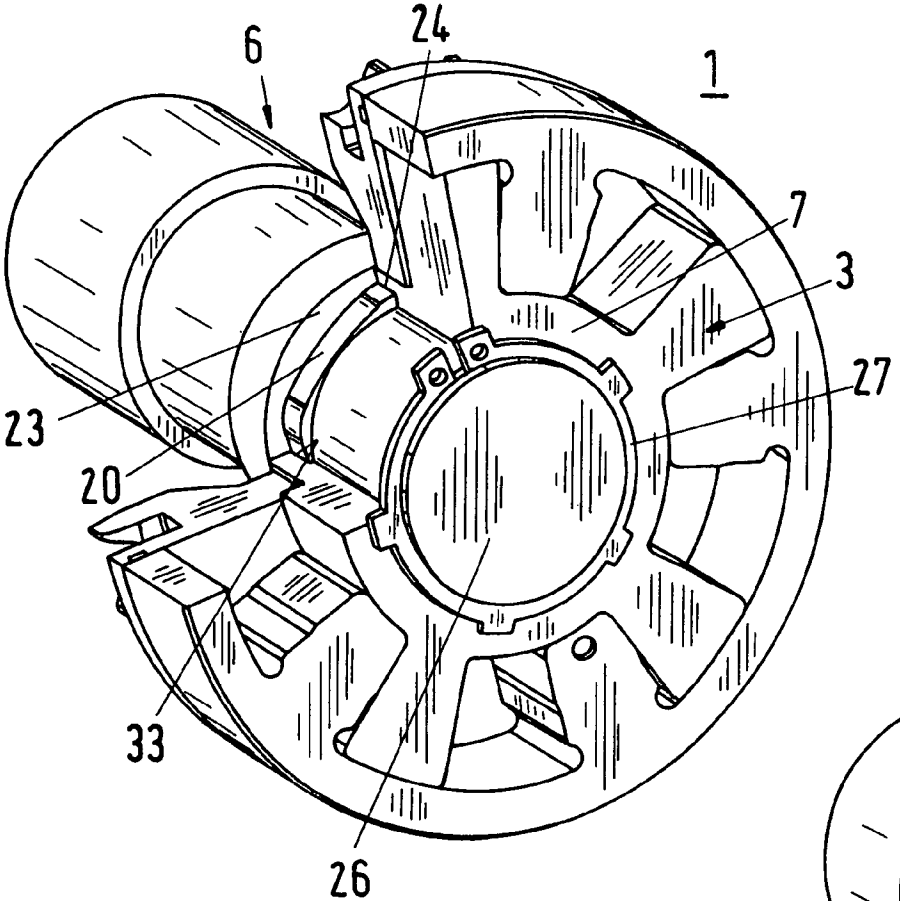
FIG. 9 shows a fifth embodiment of the camshaft adjuster according to the invention in an illustration similar to FIG. 1.
Figure 10:
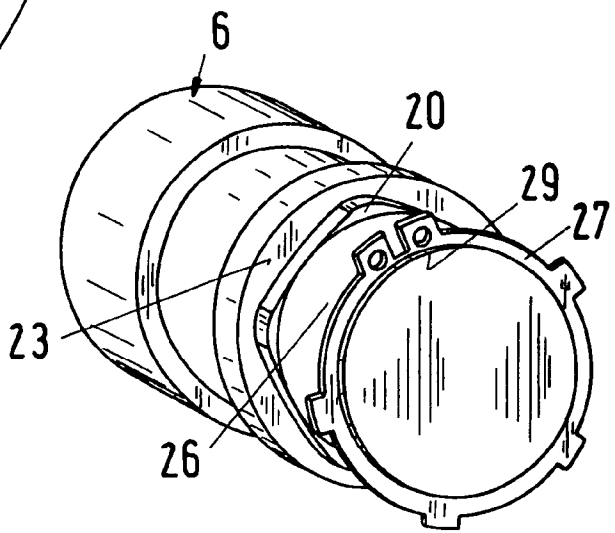
FIG. 10 shows the fifth embodiment of the camshaft adjuster in an illustration similar to FIG. 2.

FIGS. 9 and 10 show an oscillating motor where the annular projection 24 of the base member 7 of the rotor has an inner wall 33 with a non-round cross-section. The rotor is seated with this projection 24 on the positive-engagement element 20 of the camshaft 6. In contrast to the preceding embodiments, the positive-engagement connecting part 20 is formed as a collar that has only minimal axial width. The positive-engagement connecting part 20 has the same contour as the positive-engagement connecting part 20 of the preceding embodiment. The positive-engagement connecting part 20 adjoins directly the collar 23 that projects radially past the positive-engagement connecting part 20. The part 26 that is positioned on the other end of the positive-engagement connecting part 20 is cylindrical and has at its free end an annular groove 29 that receives the spring ring or securing ring 27 as an axial securing element.

In this configuration, the rotor 3 can also be pushed across the cams of the camshaft 6 to such an extent that it engages with its projection 24 the positive-engagement connecting part 20. In this way, the rotor 3 is connected in a simple way fixedly to the camshaft 6. The camshaft projects with its part 26 so far axially past the rotor 3 or the cover plate (not illustrated) that the spring ring or safety ring 27 can be inserted into the annular groove 29.

The rotor 3 is then properly secured axially on the camshaft 6. In other respects, the oscillating motor 1 is of the same configuration as in the preceding embodiments.

Figure 11:
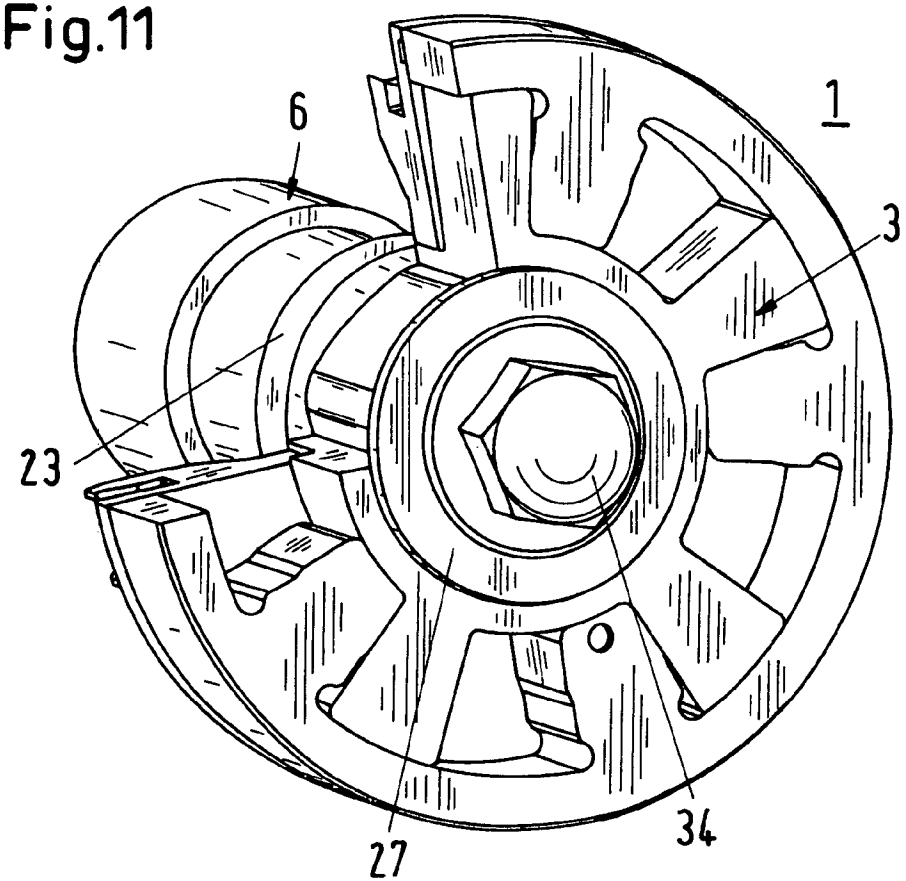
FIG. 11 shows a sixth embodiment of the camshaft adjuster according to the invention in an illustration similar to FIG. 1.
Figure 12:
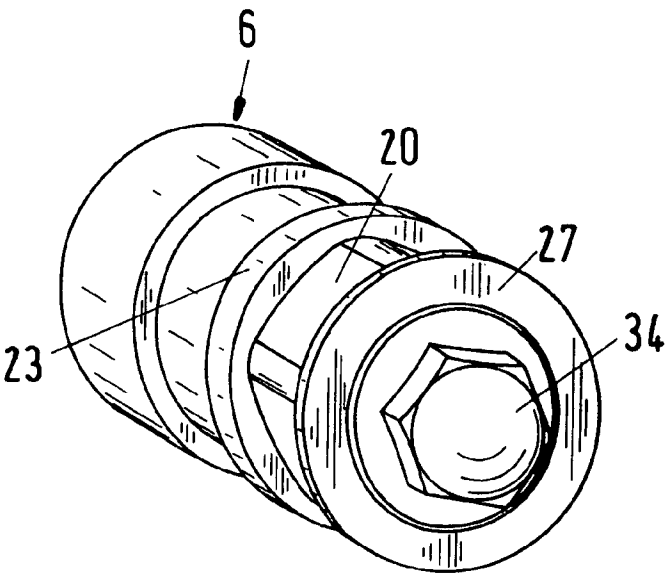
FIG. 12 shows the sixth embodiment of the camshaft adjuster in an illustration similar to FIG. 2.

FIGS. 11 and 12 show an oscillating motor 1 whose rotor 3 is pushed onto the positive-engagement connecting part 20 of the camshaft 6. The positive-engagement connecting part 20 is identical to the embodiment of FIGS. 1 and 2. As a result of the non-round cross-section of this positive-engagement connecting part 20, the rotor 3 is fixedly fastened on the camshaft 6. For axially securing the rotor 3 or the oscillating motor 1 on the camshaft 6, the axial securing element 27 as well as a groove nut 24 are provided. The axial securing element 27 in this embodiment is a securing disk that rests against the end face of the cover plate (not illustrated) and is secured by means of the groove nut 34. It is screwed onto a tapered threaded end of the camshaft 6. The rotor 3 is positioned axially secured between the collar 23 and the annular disk 27.

In other respects, the camshaft adjuster is of the same configuration as in the embodiment of FIGS. 1 and 2.

Figures 13, 14:
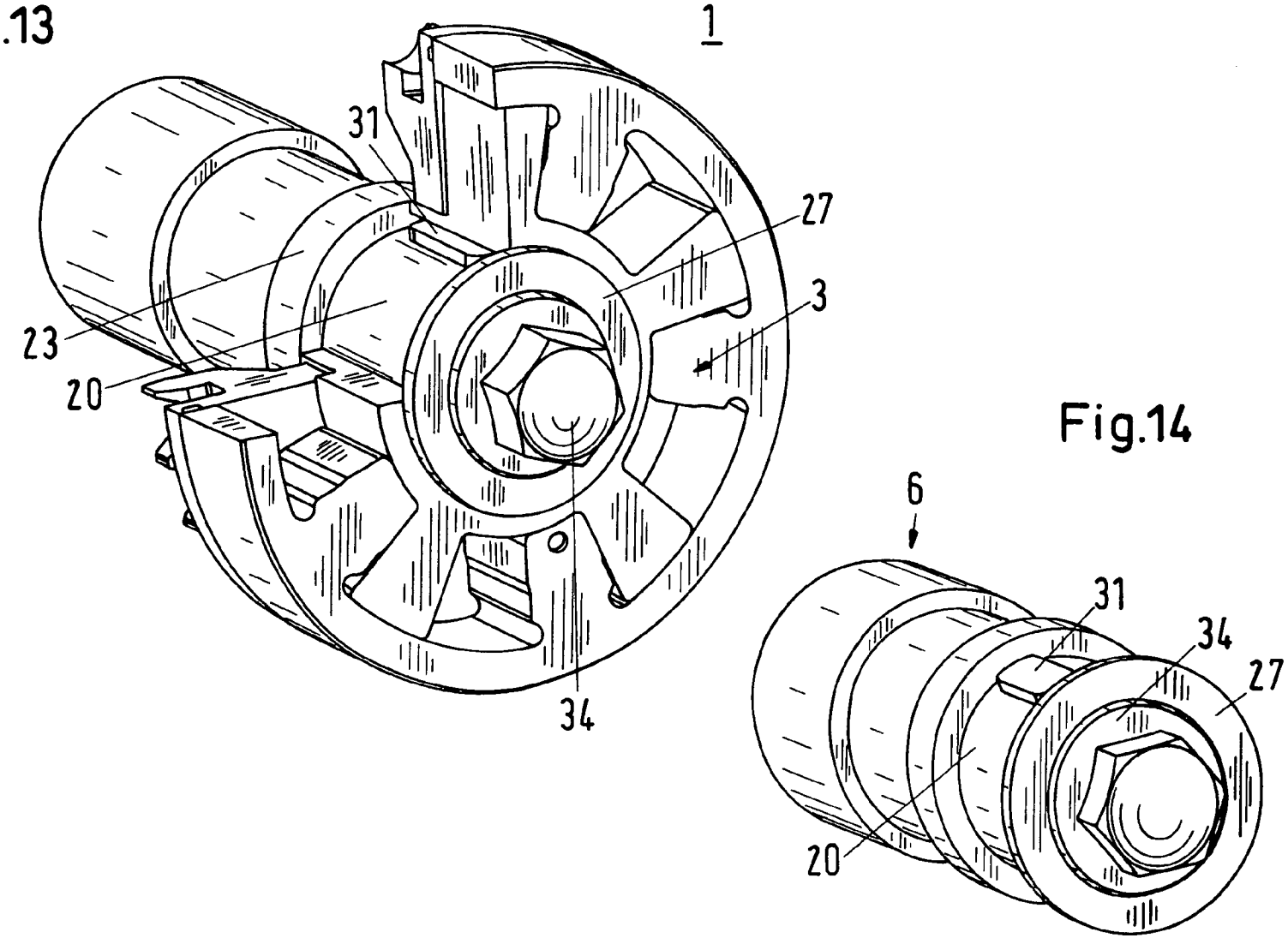
FIG. 13 shows a seventh embodiment of the camshaft adjuster according to the invention in an illustration similar to FIG. 1.
FIG. 14 shows the seventh embodiment of the camshaft adjuster in an illustration similar to FIG. 2.

The camshaft adjuster according to FIGS. 13 and 14 comprises the positive-engagement connecting part 20 with the positive-engagement element 31 in accordance with the embodiment of FIGS. 7 and 8. The camshaft 6 is provided in accordance with the preceding embodiment with a threaded end onto which the groove nut 34 is screwed. By means of the nut, the axial securing element 27 in the form of the annular disk is secured; the annular disk rests against the cover plate (not illustrated) or the rotor 3 of the oscillating motor 1 and axially secures it between the collar 23 and the axial securing element 27 in the mounted position. In other respects, the oscillating motor is identical to the embodiment of FIGS. 11 and 12.

Figure 15:
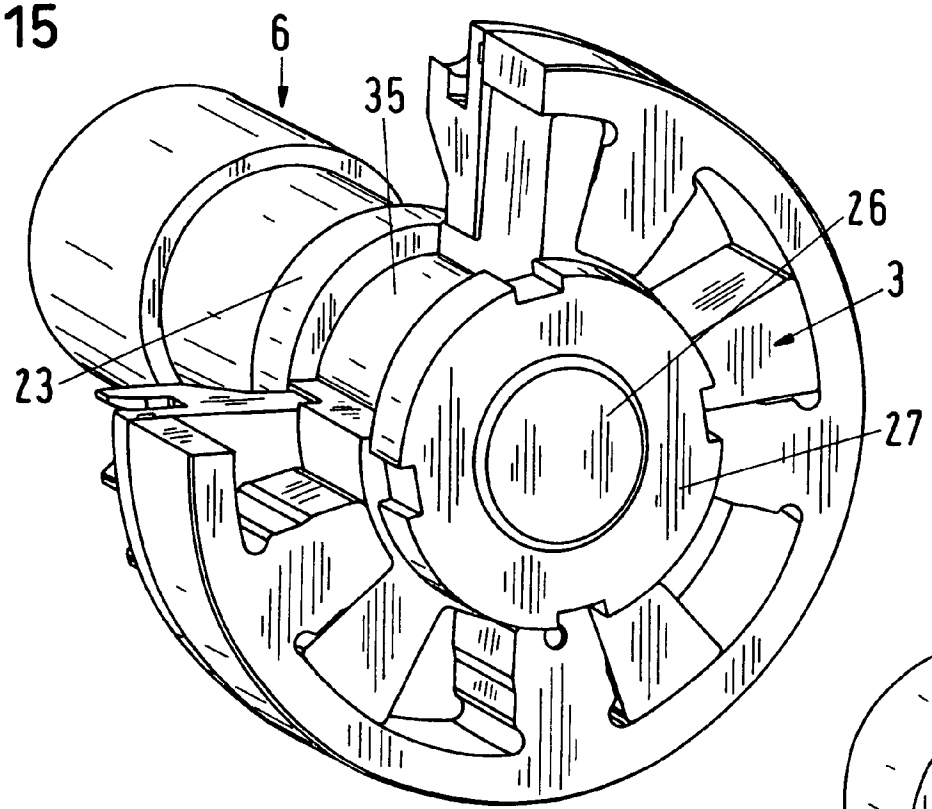
FIG. 15 shows an eighth embodiment of the camshaft adjuster according to the invention in an illustration similar to FIG. 1.
Figure 16:
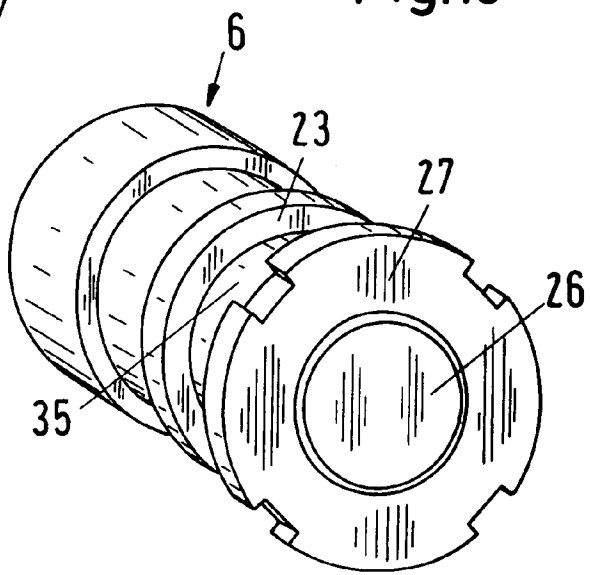
FIG. 16 shows the eighth embodiment of the camshaft adjuster in an illustration similar to FIG. 2.

The camshaft adjuster according to FIGS. 15 and 16 is similarly configured as the embodiment of FIGS. 3 and 4. In accordance with this embodiment, the axial securing element 27 is positioned on the projecting part 26 of the camshaft adjuster 6. Instead of the positive-engagement connecting part 20, the camshaft 6 has a cylindrical part 35 on which the rotor 3 is secured with press-fit. The fixed connection between the rotor 3 and the camshaft 6 is realized in this case by force transmission (friction). Onto the free end of the part 26 of the camshaft 6, the axial securing element 27 is placed in the same way as described in connection with FIGS. 3 and 4. The rotor 3 is thus axially secured between the collar 23 of the camshaft 6 and the axial securing element 27 on the camshaft 6.

Figures 17, 18:
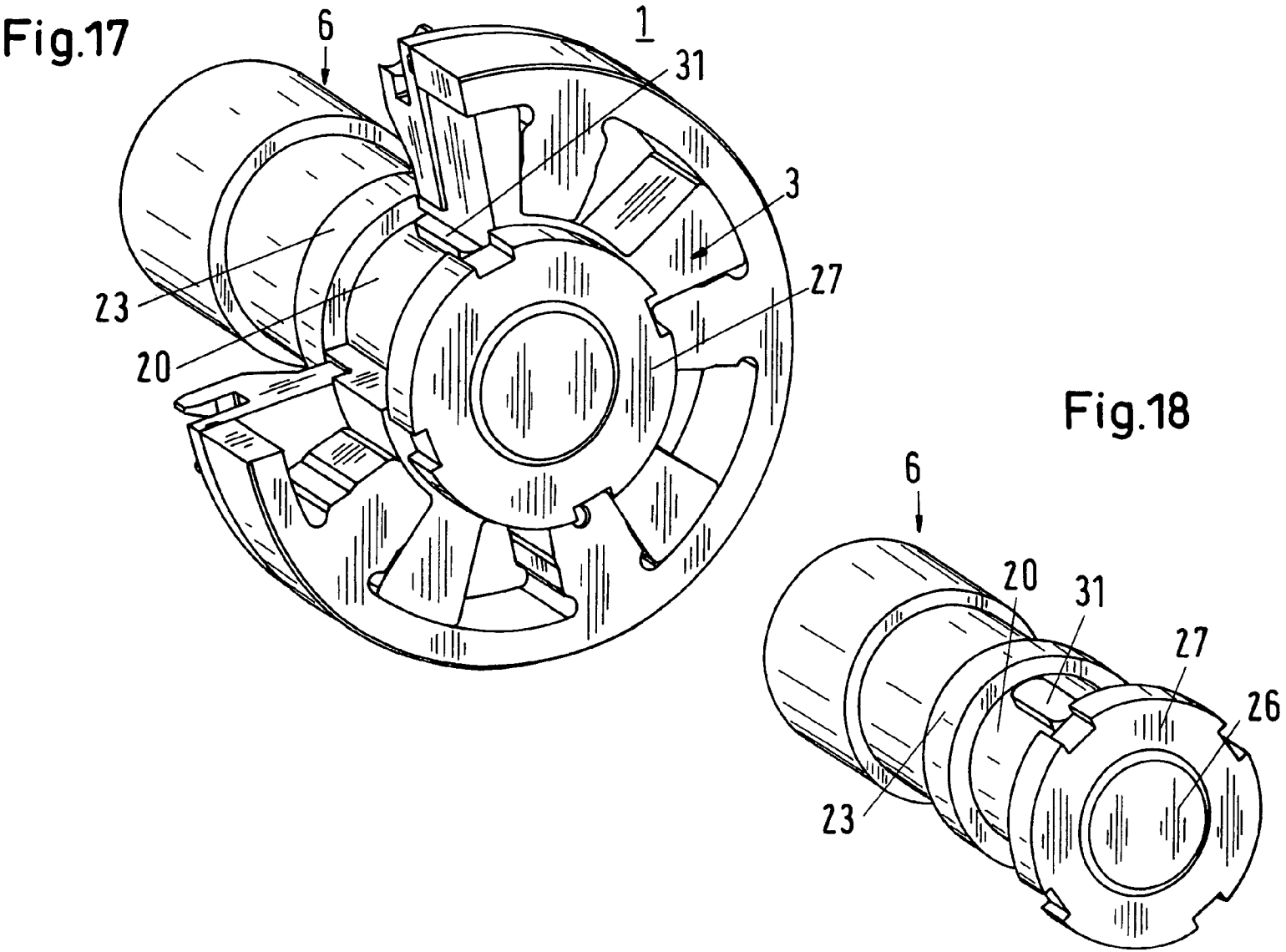
FIG. 17 shows a ninth embodiment of the camshaft adjuster according to the invention in an illustration similar to FIG. 1.
FIG. 18 shows the ninth embodiment of the camshaft adjuster in an illustration similar to FIG. 2.

In the embodiment according to FIGS. 17 and 18, the camshaft 6 has the positive-engagement connecting part 20 with positive-engagement element 31 in accordance with the embodiment of FIGS. 7 and 8. The part 26 that projects axially past the positive-engagement connecting part 20, in contrast to the embodiment of FIGS. 7 and 8, is not provided with an annular groove 29 but has a continuous cylindrical configuration. On this projecting part 26, the axial securing element 27 is fastened that is identical to that of the embodiment of FIGS. 3 and 4. The axial securing element 27 in the embodiment of FIGS. 17 and 18 can be attached in the same way as explained in connection with the embodiment of FIGS. 3 and 4. The rotor 3 of the oscillating motor 1 is axially secured between the collar 23 of the camshaft 6 and the axial securing element 27.

Figures 19, 20:
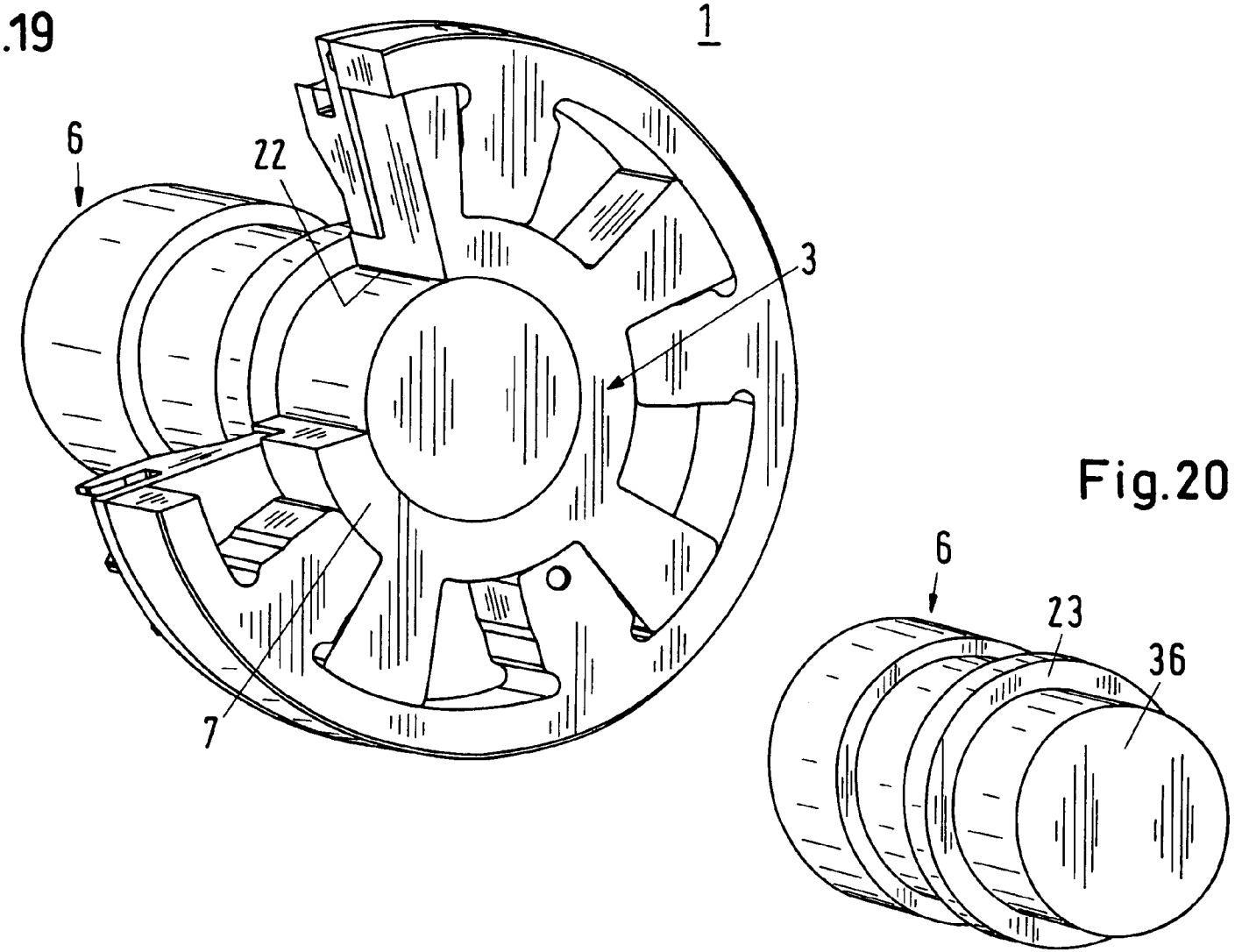
FIG. 19 shows a tenth embodiment of the camshaft adjuster according to the invention in an illustration similar to FIG. 1.
FIG. 20 shows the tenth embodiment of the camshaft adjuster in an illustration similar to FIG. 2.

In the embodiment of FIGS. 19 and 20, the camshaft 6 is provided with an axially projecting force transmission part 36 projecting past the collar 23 and configured to be of a truncated-cone shape. The base member 7 of the rotor 3 of the oscillating motor 1 is fastened on the part 36 by means of press-fit. The inner wall 22 of the rotor base member 7 is positioned on a conical surface.

Because of the force transmission between the rotor base member 7 and the force transmission part 36 of the camshaft 6, a proper fixed connection between the rotor 3 and the camshaft 6 is achieved. It is possible without problems to axially secure the rotor 3 by means of an axial securing element on the camshaft 6. The provided axial securing element 27 can be configured in accordance with the preceding embodiments.

Figure 21:
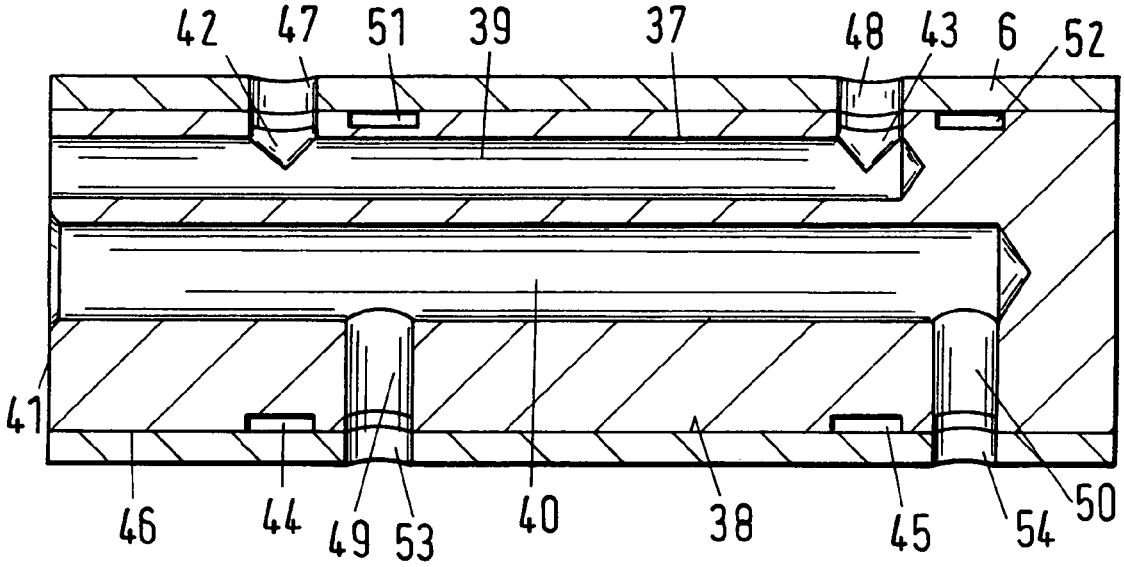
FIG. 21 shows in axial section of a camshaft embodied as a hollow shaft with an insert.

In the described embodiments, the camshaft 6 requires only two bearing locations. In particular, only a minimal number of components is required because a rotary lead-through for the pressure medium in the oscillating motor 1 is obsolete. The central screw required in the known camshaft adjusters for attachment of the oscillating motor to the camshaft is also no longer needed. The camshaft adjuster according to the described embodiments can therefore be produced simply and inexpensively. The supply of pressure medium into the pressure chambers 14, 15 is realized through the camshaft 6. In this way, radial bores for supply of pressure medium are not necessary. However, when the camshaft 6 is of a hollow configuration, an insert 37 with oil channels must be inserted as illustrated in FIG. 21. The insert 37 rests against the inner wall 38 of the hollow camshaft 6 and has two axially extending bores 39 and 40 through which the pressure medium can be introduced into the pressure chambers 14, 15 of the oscillating motor 1. The two bores 39, 40 open into a first end face 41 of the insert 37 and are connected, as is known in the art, to the valve unit with which the supply of pressure medium to the pressure chambers 14, 15 is controlled.

Radial bores 42, 43 that are spaced from one another open into the bore 39; they are provided at the bottom of an annular groove 44, 45 in the wall surface 46 of the insert 37, respectively.

The radial bores 47, 48 open in the annular groove 44, 45 into the camshaft 6.

Radial bores 49, 50 that are spaced from one another open into the axial bore 40 of the insert 37; they are provided at the bottom of two annular grooves 51, 52 in the wall surface 46 of the insert 37, respectively. Radial bores 53, 54 of the camshaft 6 open into the annular groove 51, 52.

When employing a hollow camshaft 6 with the insert 37, the constructive length can be reduced.

The axial securing of the oscillating motor 1 is realized in the described embodiments by means of the axial securing element 27 or by means of a press-fit connection.

In the embodiments in which the positive-engagement connecting part 20 has a polygonal or non-round cross-section (FIGS. 1 through 6, 9 through 12), it is advantageous when the number of corners corresponds to the number of rotor vanes 8. In this way, a uniform stress distribution is ensured in the rotor 3.

While specific embodiments of the invention have been shown and described in detail to illustrate the inventive principles, it will be understood that the invention may be embodied otherwise without departing from such principles.

What is claimed is:

1. A camshaft adjuster for motor vehicles, the camshaft adjuster comprising:

an oscillating motor comprising a rotor that is fixedly connected to a camshaft and further comprising a stator surrounding the rotor, wherein the rotor is rotatable relative to the stator;

wherein at least one connecting part acting by at least one of positive engagement and force transmission is provided on a camshaft having cams;

wherein the rotor has a base member and vanes that are connected to the base member and project radially outwardly from the base member;

wherein the base member has a central opening and is fixedly mounted with the central opening on the at least one connecting part;

wherein the central opening has an inner diameter that is greater than a diameter of a circle circumscribing the cams of the camshaft.

2. The camshaft adjuster according to claim 1, wherein the at least one connecting part is a positive-engagement part and has a non-round cross-section.

3. The camshaft adjuster according to claim 1, wherein the at least one connecting part is a positive-engagement part and has a polygonal cross-section.

4. The camshaft adjuster according to claim 3, wherein a number of corners of the polygonal cross-section matches a number of the vanes of the base member.

5. The camshaft adjuster according to claim 1, wherein the at least one connecting part is a positive-engagement part having at least one positive-engagement element.

6. The camshaft adjuster according to claim 5, wherein the positive-engagement element is provided on a cylindrical wall of the positive-engagement part.

7. The camshaft adjuster according to claim 5, wherein the positive-engagement element extends axially.

8. The camshaft adjuster according to claim 5, wherein the positive-engagement element is a rib.

9. The camshaft adjuster according to claim 5, wherein the base member of the rotor is provided with at least one groove for receiving the positive-looking element.

10. The camshaft adjuster according to claim 1, wherein the at least one connecting part is a force transmission part embodied as a cone.

11. The camshaft adjuster according to claim the 10, wherein the base member of the rotor has a wall surface that forms a conical surface.

12. The camshaft adjuster according to claim 1, wherein the connecting part is a monolithic part of the camshaft.

13. The camshaft adjuster according to claim 1, wherein the camshaft has at least one axial stop for the oscillating motor.

14. The cam shaft adjuster according to claim 13, wherein the axial stop is a radial collar of the camshaft.

15. The camshaft adjuster according to claim 13, wherein the axial stop is a monolithic part of the camshaft.

16. The camshaft adjuster according to claim 13, wherein the connecting part extends away from the axial stop.

17. The camshaft adjuster according to claim 1 further comprising at least one axial securing element configured to be fastened on the camshaft.

18. The cam shaft adjuster according to claim 17, wherein the axial safety element frictionally engages the camshaft.

19. The camshaft adjuster according to claim 17, wherein the axial securing element is positively engages the camshaft.

20. The camshaft adjuster according to claim 17, wherein the axial safety element is press-fit onto a free end of the camshaft.

21. The camshaft adjuster according to claim 17, wherein the axial safety element is annular.

22. The camshaft adjuster according to claim 17, wherein the axial securing element is a spring ring.

23. The camshaft just to according to claim 17, wherein the axial securing element is an annular disk secured by a groove nut.

24. The camshaft adjuster according to claim 23, wherein the groove nut is screwed onto a threaded end of the camshaft.

25. The camshaft adjuster according to claim 1, wherein the camshaft is a hollow shaft.

26. The camshaft adjuster according to claim 25, further comprising an insert inserted into the hollow shaft.

27. The cam shaft adjuster according to claim 26, wherein the insert has supply lines for a pressure medium.

28. The camshaft adjuster according to claim 27, wherein the camshaft has radial bores communicating with the supply lines of the insert.

* * * * *